US012270283B2

(12) United States Patent
Clark et al.

(10) Patent No.: US 12,270,283 B2
(45) Date of Patent: Apr. 8, 2025

(54) ACOUSTIC STIMULATION

(71) Applicant: Global Post Graystone Inc., Victoria (CA)

(72) Inventors: Gregory Allen Clark, Victoria (CA); Ann-Marie Harmon De Clare, Victoria (CA)

(73) Assignee: Global Post Graystone Inc. (CA)

( * ) Notice: Subject to any disclaimer, the term of this patent is extended or adjusted under 35 U.S.C. 154(b) by 0 days.

(21) Appl. No.: 18/453,014

(22) Filed: Aug. 21, 2023

(65) Prior Publication Data

US 2024/0076963 A1 Mar. 7, 2024

Related U.S. Application Data

(63) Continuation of application No. 17/577,593, filed on Jan. 18, 2022, now Pat. No. 11,773,696, which is a continuation of application No. 15/202,026, filed on Jul. 5, 2016, now Pat. No. 11,225,856.

(51) Int. Cl.
*E21B 28/00* (2006.01)
*E21B 43/00* (2006.01)

(52) U.S. Cl.
CPC ..... *E21B 43/003* (2013.01); *E21B 28/00* (2013.01)

(58) Field of Classification Search
CPC ..... E21B 28/00
See application file for complete search history.

(56) References Cited

U.S. PATENT DOCUMENTS 4,345,650 A * 8/1982 Wesley ..... E21B 43/003 166/177.2
5,098,538 A 3/1992 Bung et al.
6,427,774 B2 * 8/2002 Thomas ..... E21B 28/00 166/177.2
2011/0088802 A1 4/2011 Bryden
2011/0139440 A1 6/2011 Zolezzi-Garreton
(Continued)

FOREIGN PATENT DOCUMENTS

WO 2010146016 A1 12/2010

OTHER PUBLICATIONS

European Patent Office, PCT International Application No. PCT/EP2017/066667, International Search Report and Written Opinion dated Dec. 12, 2017, 22 pages.
(Continued)

*Primary Examiner* — William D Hutton, Jr.
*Assistant Examiner* — Avi T Skaist
(74) *Attorney, Agent, or Firm* — McAndrews, Held & Malloy, Ltd.

(57) ABSTRACT

A downhole acoustic stimulation tool comprises: a sealed chamber containing a liquid; a pair of electrodes located in the chamber; at least one transducer arranged to generate an acoustic field between the electrodes thereby inducing cavitation in a volume of the liquid between the electrodes; and at least one capacitor configured to apply a pulse voltage across the electrodes when discharged, thereby causing the cavitating volume of liquid to form a plasma which collapses to form a shockwave. The at least one transducer constitutes a first energy source, and the at least one capacitor back and electrodes constitute a second energy source. Alternative forms and arrangements of the first and second energy sources are also disclosed.

5 Claims, 5 Drawing Sheets

(56) References Cited

U.S. PATENT DOCUMENTS

| | | | | |
|---|---|---|---|---|
| 2014/0305877 | A1* | 10/2014 | Cioanta | E21B 43/26 134/1 |
| 2016/0024888 | A1 | 1/2016 | Parker et al. | |

OTHER PUBLICATIONS

Brian Champion, Fred Van Der Bas, Gerrit Nitters, The Application of High Power Sound Waves for Wellbore Cleaning, SPE International, dated May 13-14, 2003, 10 pages.
European Patent Office, Official Action regarding European Application No. 17742171.6, 4 pages dated Mar. 26, 2020.

* cited by examiner

ACOUSTIC STIMULATION

RELATED APPLICATIONS

The present patent application is a continuation of U.S. patent application Ser. No. 17/577,593, filed Jan. 18, 2022, which is a continuation of U.S. Pat. No. 11,225,856, filed Jul. 5, 2016, the content of which is hereby incorporated by reference in its entirety into this disclosure.

FEDERALLY SPONSORED RESEARCH OR DEVELOPMENT

[Not Applicable]

FIELD OF TECHNOLOGY

The present invention relates to acoustic treatment of hydrocarbon (i.e. oil or gas) wells, or other natural resource wells (e.g. water).

BACKGROUND

Acoustic treatment refers to a form of well treatment, wherein a downhole tool is lowered into a well. The downhole tool is electrically powered, and converts electrical energy into acoustic energy, i.e. physical vibrations within a fluid (gas or liquid) or solid. The acoustic energy radiates outwardly from the tool and into a natural resource-bearing formation surrounding the well. The resource may for example be hydrocarbon (oil or gas) or water.

The acoustic energy is high enough to cause a release of targeted natural resources (e.g. hydrocarbons or water) from the surrounding formation, but low enough that the well components, and in particular the cement sheath and any casing, are undamaged. More powerful versions of acoustic stimulation technology may create some micro-fractures within the formation itself, which improve permeability, but these are on a much smaller scale than those induced by conventional hydro-fracking.

Some existing acoustic stimulation tools comprise at least one transducer, which is an electrical device that converts electrical energy into acoustic energy directly. This generally results in a relatively narrow acoustic energy spectrum, in which the total energy is confined to a single frequency of narrow frequency range, e.g. ultrasound (above about 20 kHz). A radiating surface may be coupled to the transducer, from which the acoustic energy is radiated into the formation in a desired direction.

Other existing "electrohydraulic" acoustic stimulation tools instead operate based on an indirect conversion of electrical energy into acoustic energy, in the form of a shockwave. These comprise a pair of electrodes, and operate by generating a transient electrical discharge across the electrodes. When submerged in a liquid, the electrical discharge has sufficient energy to induce a localized phase transition, in which a volume of the liquid between the electrodes is briefly vaporized and ionized so as to form a plasma (i.e. an ionized gas), which quickly collapses (i.e. returns to the original liquid phase). This creates a shockwave in the liquid, which propagates outwardly into the formation. The shockwave is a broadband acoustic energy pulse, i.e. its total energy is spread across a relatively wide range of frequencies (e.g. from fractions of a Hertz up to tens of kHz).

BRIEF SUMMARY

Note the term "acoustic stimulation" refers generally to a reaction (physical and/or chemical) that is induced within a resource-bearing formation (e.g. in a well in the formation or elsewhere in the formation), which has an acoustic effect on the formation. The cause of the reaction may or may not be acoustic, for example it may or may not be induced using an acoustic field.

The reaction may be what is referred to herein as a "sonochemical" reaction, in which cavitation is induced in a liquid in the formation, which may for example be in a well liquid or in a liquid induced within a chamber of a tool and/or an alkaline solution, and a voltage applied across the cavitating liquid to form a plasma. The cavitation may or may not be induced using an acoustic field (e.g. ultrasound), for example the cavitation may also by hydrodynamic cavitation (hydrocavitation) induced by manipulating a flow of the fluid to create the necessary pressure gradient, for example using a pump of other fluid manipulation means. That is, the term "sonochemical reaction" is not limited to cavitation induced by an acoustic field (e.g. ultrasound), but encompasses cavitation induced by any means whatsoever, including but not limited to hydrocavitation.

A first aspect of the present invention is directed to a downhole acoustic stimulation tool comprising:

- a sealed chamber containing a liquid;
- a pair of electrodes located in the chamber;
- at least one transducer arranged to generate an acoustic field between the electrodes thereby inducing cavitation in a volume of the liquid between the electrodes; and
- at least one capacitor configured to apply a pulse voltage across the electrodes when discharged, thereby causing the cavitating volume of liquid to form a plasma which collapses to form a shockwave.

According to the phenomenon of cavitation, the acoustic field (typically ultrasound) induces localized phase changes in a liquid (i.e. from a liquid phase to a gas phase) resulting in small bubbles of vaporized liquid. When these bubbles collapse, they release energy into the volume of liquid as heat—resulting in extremely high temperatures and pressure differentials that are localized to small regions of the cavitation liquid. A consequence is to enhance the conductivity of the liquid.

The magnitude of the pulse voltage required to form the plasma depends on the distance between the electrodes and the conductivity of the liquid. By reducing the distance between the electrodes, it would be possible to form a plasma with a smaller pulse voltage. However, this would reduce the size of the plasma i.e. it would reduce the volume of the liquid that is converted to plasma, as well as the size of the cavity formed, and consequently the intensity of the resulting shock wave.

An effect of the cavitation is to significantly reduce this voltage requirement for a given distance between the electrodes i.e. making it possible to form the plasma with a pulse voltage of significantly lower magnitude due to the cavitation, without moving the electrodes closer together. This, in turn, reduces the amount of energy that needs to be stored and released by the tool's capacitor(s), without reducing the volume of plasma that is created.

The term "plasma event" is used herein to refer to the formation of the plasma that subsequently collapses to form the shockwave.

The downhole tool may house an ultrasound generator or other high frequency generator, which is a frequency converter. Note that the ultrasound generator is not the component that generates ultrasound as such, but rather which generates an AC electrical signal with high frequency (e.g. at least 20 HKz) for driving the transducer, the transducer being the component that converts this high frequency electrical signal to a high frequency acoustic field, such as ultrasound. It is generally preferable for the high frequency generator to be included in the tool itself rather than to transmit a high frequency signals down the cable, as this will generally result in lower attenuation (i.e. less energy lost from the cable). For example, a power input of the tool may be configured to connect to a surface power supply unit via the supply cable, which supplies supplying 380V, 3 phase AC voltage at a standard frequency of around 50 Hz or 60 Hz, which is then converted to a higher frequency voltage by the high frequency generator on board to the tool. Nevertheless the possibility of instead generating the high frequency electrical signal at the surface in certain circumstances is not excluded, in which case a high frequency generator is not required on-board the tool.

In embodiments the tool may comprise a capacitor charge/discharge system coupled to the at least one capacitor for controlling its charging and discharging.

The tool may also comprise a communication interface, for connecting to an HMI (human-machine interface, also referred to as a user interface herein) for control and monitoring of the treatment by a human operator.

In use, the tool of the first aspect or any embodiment thereof (or indeed any of the various tools disclosed herein) can be deployed on a wireline or e-line; or it can be permanently installed, tubing deployed; or deviated, horizontal well coiled tubing deployed.

In embodiment the downhole tool may comprise a plurality of capacitor units connected in parallel, each comprising at least one capacitor; and a voltage control unit configured to discharge the capacitor units asynchronously to apply a series of pulse voltages across the electrodes.

A duration between successive pulse voltages may be less than a charging time of each capacitor unit.

Alternatively or in addition, the capacitor may be one of a plurality of capacitors of the tool connected for charging in parallel and discharging in series.

For example, each of the capacitor units may comprise a plurality of capacitors connected for charging in series and discharging in parallel. For example, the or each plurality of capacitors forms a Marx generator.

The at least one transducer constitutes a first energy source, and the at least one capacitor back and electrodes constitute a second energy source. Alternative forms and arrangements of the first and second energy sources are considered, in other aspects of the present invention set out below.

A second aspect of the present invention is directed to a method of applying acoustic stimulation to a resource-bearing formation, the method comprising: lowering a downhole tool into a well; generating an acoustic field between electrodes of the tool, thereby inducing cavitation in a volume of liquid between them; and generating a pulse voltage across the electrodes, thereby causing the cavitating volume of liquid to form a plasma, which collapses to form a shockwave that propagates into a resource-bearing formation surrounding the well.

In embodiments, a series of shockwaves may be generated by repeatedly generating pulse voltages across the electrodes.

The tool may have a geometry such that a natural resonance frequency of the tool matches a discharge frequency of the series of pulse voltages.

A third aspect of the present invention is directed to a method of applying acoustic stimulation to a resource-bearing formation, the method comprising: lowering a downhole tool into a well; and generating a pulse voltage across electrodes of the tool, thereby creating a shockwave that propagates into the hydrocarbon-bearing formation surrounding the well; wherein the shockwave induces vibrations in the formation over a range of frequencies above 20 kHz having a cumulative power flux density of at least 0.8 W/cm2.

For example, the vibrations over the range of frequencies above 20 kHz have a cumulative power flux density of at least 1 W/cm2.

A fourth aspect of the present invention is directed to a downhole acoustic stimulation tool comprising: a pair of electrodes; and a plurality of capacitor units connected in parallel, each comprising at least one capacitor; and a voltage control unit configured to discharge the capacitor units across the electrodes asynchronously, thereby applying a series of pulse voltages across the electrodes.

In embodiments, a duration between successive pulse voltages may be less than a charging time of each capacitor unit.

A fifth aspect of the present invention is directed to a method of applying acoustic stimulation to a resource-bearing formation surrounding a well, the method comprising: estimating at least one characteristic of the well and/or the surrounding formation; determining an operating frequency for a downhole tool using the estimated at least one characteristic; and using a downhole tool in the well to apply, to the surrounding formation, acoustic stimulation at the determined operating frequency; wherein the at least one characteristic comprises: a speed of sound in the surrounding formation, an oil-to-water ratio, an oil-to-gas ratio, a neutron density of the formation, an interfacial boundary estimate, a consolidation measure for the formation, or an API gravity of a fluid in the well or formation.

A sixth aspect of the present invention is directed to a method of applying acoustic stimulation to a resource-bearing formation surrounding a well, the method comprising: estimating at least one characteristic of the well and/or the surrounding formation; determining a treatment duration using the estimated at least one characteristic; and using a downhole tool in the well to apply, to the surrounding formation, acoustic stimulation for substantially the determined duration; wherein the at least one characteristic comprises: a speed of sound in the formation, a resource fluid characterization, a neutron density of the formation, an interfacial boundary estimate, a consolidation measure for the formation, a porosity of the formation, a permeability of the formation.

In embodiments, the resource fluid characterization may comprise an oil-to-water ratio, an oil-to-gas ratio, a density of a fluid contained in the formation, or a dynamic viscosity of a fluid contained in the formation. That is, one of those elements or any combination of two or more of those elements.

The resource may for example be hydrocarbon. Alternatively the resource may be water.

A seventh aspect of the present invention is directed to a downhole acoustic stimulation tool comprising: a pair of electrodes; a feed mechanism arranged to feed a metallic conductor between the electrodes; and a plurality of capacitors connected so as to charge in parallel and discharge in series across the electrodes.

Note this feed mechanism is unique to the seventh aspect.

An eight aspect of the present invention is directed to a downhole acoustic stimulation tool comprising: a chamber; a pair of electrodes located in the chamber; and a plurality of capacitors connected so as to charge in parallel and discharge in series across the electrodes.

The chamber may be a sealed chamber containing a liquid.

The capacitors may be connected so as to form a Marx generator.

A ninth aspect of the present invention is directed to a downhole acoustic stimulation tool according to the seventh or eighth aspect, or any embodiment thereof, comprising: a plurality of capacitor units connected in parallel, each comprising at least one capacitor; and a voltage control unit configured to discharge the capacitor units across the electrodes asynchronously, thereby applying a series of pulse voltages across the electrodes.

A tenth aspect of the present invention is directed to a method of applying acoustic stimulation to a resource-bearing formation, the method comprising: using a first energy source to generate an acoustic field at a location in the formation; using a second energy source to direct energy into the acoustic field.

An eleventh aspect of the present invention is directed to a method of applying acoustic stimulation to a resource-bearing formation, the method comprising: using a first energy source to induce cavitation in a volume of liquid in the formation; and using a second energy source to direct energy into the cavitating volume of liquid.

The directed energy may interact with the acoustic field or the cavitating liquid to cause a release of a resource from the formation.

The acoustic filed may be generated in or the volume of liquid may be located in a well within the formation.

The acoustic field may have an ultrasonic frequency.

The directed energy may comprise electrical energy. That is, the second energy source may comprise an electrical energy source, such as a capacitor and electrodes.

The second energy source may comprise a pair or electrodes.

For example, both of the electrodes may be located on a downhole tool. The electrodes are used to apply a voltage across part of the formation.

Alternatively, one of the electrodes may be located at the surface and the other may be located within the formation.

A discharge across the electrodes may be controlled by software executed on a computer.

The second energy source may comprise an electromagnetic energy source.

Electromagnetic energy emitted by the electromagnetic energy source may comprise microwave, visible light, infrared, radio wave, gamma ray and/or ultraviolet energy.

The directed energy and the acoustic field or the cavitating liquid may interact to form a plasma, which collapses to form a shockwave.

The second energy source may be located at ground-level.

Alternatively, the second energy source may be a component of a downhole tool.

The directed energy and the acoustic field or the cavitating liquid may interact to create hydrogen.

The method may comprise comprising executing control software on a computer, wherein the control software uses a sensor to monitor the location of the acoustic field or the cavitating volume of liquid, and to control the directing of energy therein.

For example, the control software may use the sensor to detect a hydrogen spike caused by said directing of energy into the acoustic field or cavitating volume of liquid, and in response to the detection of the hydrogen spike, cause an increase in the amount of energy in acoustic field or cavitating liquid. For example, the software may use the second energy source to increase the amount of energy.

At least part of the increased energy may be released into the formation as heat.

Alternatively or in addition, the directed energy and the acoustic field or the cavitating liquid may interact to create nanoparticles.

The nanoparticles coat (larger) particles within the formation, for example native particles in the formation. For example, the formation may be an oil sand or a natural resource reservoir, and the nanoparticles coat sand particles of the oil sand or the natural resource reservoir.

The nanoparticles may coat at least a portion of the surface of a downhole tool to form a protective layer thereon.

The first energy source may comprise a transducer. Alternatively or in addition the first energy source may comprise a hydrodynamic cavitation induction mechanism.

For example, the hydrodynamic cavitation induction mechanism may comprise a pump, a control valve, a heating element and/or a suction element.

A twelfth aspect of the present invention is directed to a system for applying acoustic stimulation to a resource-bearing formation, the system comprising: a first energy source configured to generate an acoustic field at a location in the formation or resource; a second energy source configured to direct energy into the acoustic field, such that a combination of acoustic energy of the acoustic field and the directed energy causes a release of a resource from the formation.

A thirteenth aspect of the present invention is directed to a system for applying acoustic stimulation to a resource-bearing formation, the system comprising: a first energy source configured to induce cavitation in a volume of liquid in the formation; a second energy source configured to direct energy into the cavitating volume of liquid, such that a combination of the cavitating volume of liquid and the directed energy causes a release of a resource from the formation.

A fourteenth aspect of the present invention is directed to a downhole acoustic stimulation tool comprising: a pair of electrodes; a first energy source configured to produce bubble cavitation in a volume of liquid between the electrodes; and a second energy source configured to direct energy into the volume of liquid.

The second energy source may comprise at least one capacitor configured to apply a pulse voltage across the electrodes when discharged, for causing the cavitating volume of liquid to form a plasma.

The electrodes may be external electrodes for forming a plasma in a liquid when the tool is submerged in the liquid.

In some embodiments, and in embodiments of the first aspect in particular, the downhole tool may also comprise a power input for connecting to an electrical cable; and secondary voltage supply circuitry arranged to supply, directly from the electrical cable, a secondary voltage across the cavitating volume of liquid.

The secondary voltage may be supplied for a duration after the pulse voltage is applied (e.g. 10 ms, order of magnitude) to maintain the plasma, wherein the collapse occurs upon removal of the secondary voltage at the end of the duration. This is not essential however, particularly if the tool is operating at a relatively high discharge frequency to create, say, tens, hundreds or even thousands of plasma events per second.

The amount of energy that can be stored in a capacitor is limited by its physical size. Hence the amount of energy that can be stored on-board the tool is limited by the size and number of its constituent capacitors, which is turn is limited by the size of the tool. There is therefore a maximum energy that can be stored on-board the tool that is limited by the size of the tool.

An effect of the cavitation is to allow energy to be transferred into the volume of liquid directly from the electrical cable (i.e. above and beyond that stored in the tool's capacitor(s)) by applying the secondary voltage. That is, the combination of the secondary voltage and the cavitation causes electrical power to flow directly into the plasma for as long as the secondary voltage is applied.

This allows the energy of the resulting shock wave to be increased significantly above the maximum energy that can be stored in the capacitor(s) on-board the tool. Therefore it allows a higher energy shockwave to be created without increasing the size of the tool.

The tool can be sized to fit inside oil well tubing (e.g. having a diameter of about 42 mm), so that it can be used without removing the oil well tubing form the well. Or it may be larger, for use once the oil well tubing has been removed. The physical diameter may be adjusted to suit the deployment method (e.g. wireline; e-line; coiled tubing; and or tubing-deployed permanent installation).

BRIEF DESCRIPTION OF FIGURES

For a better understanding of the present invention, and to show how the same may be carried into effect, reference is made to the following figures, in which.

DETAILED DESCRIPTION

Figure 1:
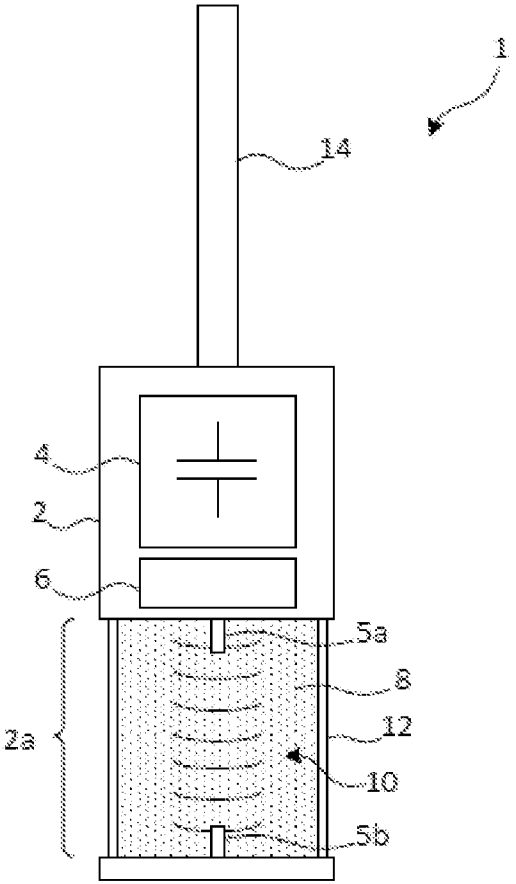
FIG. 1 shows a schematic block diagram of a downhole tool in cross section.

FIG. 1 shows a downhole tool 1 for use in a well to stimulate a surrounding resource-bearing formation. In the examples described below, the resources are hydrocarbons, however the tool can also be applied to other types of resource-bearing formations, such as water-bearing formations.

The tool 1 comprises a body 2, which includes a hollow, sealed chamber 2*a* containing a working fluid, in the form of a liquid 8. A pair of electrodes 5*a*, 5*b* of the tool 1 are housed within the chamber 2*a* and thus submerged in the liquid 18. The tool 1 comprises a voltage control unit 32 and a discharge unit 4, which receives electrical power from the surface via a cable 14, one end of which is attached to the body 2. The cable 14 is a geophysical logging cable. The discharge unit 4 is coupled to the electrodes 5*a*, 5*b*, such that it can generate a series of transient electrical discharges across them, each having a voltage that rapidly decays (pulse voltage). The discharge unit 4 comprises at least one capacitor, and is controlled by a capacitor charge/discharge system of the voltage control unit 32.

The tool 1 comprises a high frequency generator, which is an ultrasound generator 7 in this example, at least one transducer 6 coupled to the ultrasound generator 7, which converts electrical energy received via the cable 14 into acoustic energy, thereby generating an acoustic field 10 (e.g. ultrasound field) between the electrodes 5*a*, 5*b*. The electrical energy is received at the ultrasound generator 7, and converted to a high-frequency electrical signal (e.g. at least 20 kHz) that drives the transducer 6 to generate the ultrasound field 10. The transducer 6 is located inside the chamber 2*a* in this example, such that the acoustic field 10 is generated between the electrodes 5*a*, 5*b*. A radiating surface (not shown) may also be located in the chamber 2*a* and coupled to the transducer 6, which is arranged to focus the acoustic energy between the electrodes 5*a*, 5*b*.

Alternatively, the transducer 6 may be located in the tool 2 outside of the chamber 2*a*, and may be coupled to a radiator (sonotrode) that permeates the chamber. Vibrations induced by the transducer propagate along the radiator into the chamber 2*a* to generate the acoustic field 10. In some cases, the radiator may be one of the electrode 5*a*, 5*b* themselves, such that the vibrations propagate though the electrode itself, or a separate radiator may be used.

The chamber 2*a* has a substantially cylindrical shape about the axis of the tool, and has a sidewall, which is a flexible membrane 12. The flexible membrane 12 is tough enough to withstand the operating conditions yet flexible enough to transmit the acoustic energy produced.

Each electrical pulse applied to the electrodes 5*a*, 5*b* vaporizes and ionizes a volume of the fluid 8 between the electrodes 5*a*, 5*b*, such that it forms a plasma. When the plasma collapses, a shockwave is formed, which propagates though the flexible membrane 12 and into the surrounding formation. The flexible membrane 12 is such that it absorbs minimal energy from the shockwave, so that most of the shockwave energy is transferred into the formation as desired.

The purpose of the acoustic field 10 is not to stimulate the formation as such, but rather to drive the physical processes that lead to the formation and collapse of the plasma. In particular, the acoustic field 10 induces cavitation in the liquid 8 between the electrodes 5*a*, 5*b*.

When the electrodes 5*a*, 5*b* are discharged across the cavitating liquid, this causes it to form a plasma, which is a much larger cavity, i.e. a much larger contiguous volume of vaporized liquid 8 that also happens to be ionized. This larger cavity (i.e. the plasma) collapses as the vaporized fluid returns to the liquid phase, to form the acoustic shockwave, which is a broadband acoustic pulse (16, FIG. 2A—see below). The larger cavity has a size that is of similar order to the distance separating the electrodes 5*a*, 5*b*.

This chain of effects, i.e. where the plasma is formed in the liquid 8 through a combination of pulse voltage and cavitation, is referred to as a "plasma event". In use, a series of plasma events are induced, possibly in quick succession, to generate a series of shockwaves.

The problem solved by this arrangement can be seen as an energy conversion problem, where the aim is to convert electrical power into acoustic power in a desired frequency range, as efficiently and effectively as possible.

An effect of the ultrasound field 10, and of the cavitation in particular, is such that the amount of electrical energy needed to create the larger cavity (i.e. the plasma) is reduced, as the total energy used to create the cavity is augmented by the cavitation induced between the electrodes 5*a*, 5*b* by the acoustic field 10. In other words, in order to create the desired plasma event, the tool uses two types of energy:

Ultrasonic energy between the electrodes resulting in cavitation; this allows for ionization, making the fluid more conductive (the "spark-plug");

Electrical voltage potential across the electrodes produces a larger plasma cavity with less power, therefore when the cavity collapses the energy released in the form of the acoustic pulse will be greater than an equivalent plasma event without ultrasound.

The plasma event displaces the surrounding fluid, and on collapse the total energy used to create the cavity—some of which has come from the voltage pulse and some of which has come from the acoustic field 10 (that is, from the transducer 6)—is converted to acoustic energy in the form of a shock wave broadband pulse. That power of the rebounding acoustic energy is dependent on the size of the larger cavity created.

With the present tool 1, more energy is transferred to the formation by repeating the plasma events more often. This is a different approach to existing electrohydraulic tools, which seek to increase the energy by generating a more powerful plasma event. In other words, the aim is not necessarily one of creating more powerful pulses, put rather allowing the pulses to be repeated at a frequency that allows the accumulation of these pulses to potentially form powerful ultrasonic fields in the near well bore region (i.e. such that the series of shockwaves created a powerful ultrasonic field in the surrounding formation itself). Existing types of electro-hydraulic tool may in fact be able to produce a higher energy shock wave, but are not able to achieve as high a discharge frequency. For example, the existing tools able to achieve the highest energy pulses typically need a charging time of around 30 seconds, i.e. they can only create about two pulses per minute. Another existing tool created lower energy pulses, but still needs 3-5 seconds to recharge between pulses. By contrast, because the present tool 1 needs less energy per-voltage pulse, the discharge unit 4 can recharge much faster, and is expected to be able to generate 10s, 100s, or even 1000s of pulses every second per second, resulting in an increased overall acoustic power density. This rapid pulsing can also lead to a second, high frequency acoustic (e.g. ultrasound) field being created externally of the tool 1 (distinct from the internal acoustic field 10 created within the chamber by the transducer 6 directly) in a surrounding region of the well and/or formation. This second external acoustic field can induce sonochemical effects externally of the tool, i.e. such that the series of shockwaves induces chemical effects externally of the tool within a region the well and/or surrounding formation, for example by inducing cavitation externally of the tool, i.e. the rapid sequence of shockwaves may induce external cavitation and/or other physical effects characteristic of high-frequency acoustic fields such as ultrasound (distinct from the cavitation within the chamber 2*a*, which is caused by the transducer 6 and internal acoustic field 10 directly). This is referred to as the creation of a sonochemical environment.

The actual frequency of discharge will be technically limited to the available electrical power supply, the physical characteristics of the fluid 8 contained in the chamber, how readily it reacts to the sonic stimulation and cavitation, how well it responds to the plasma event and subsequent plasma cavity collapse, and how well it transmits that acoustic energy to the surrounding well fluids and formation.

The present tool 1 thus provides a means of producing as large a cavity and subsequent shockwave as possible, and as frequently as possible, given the available power supply.

The configuration of the tool 1 is also beneficial in terms of heat dissipation, as the plasma that is produced in the tool 1 is a cold plasma, having a significantly lower temperature than a so-called hot (metallic) plasma formed by exploding a metallic conductor. A tool of this kind comprises a feed mechanism, for feeding a metallic conductor between the electrodes. Such feed mechanisms are known in the art.

In some cases, depending on the composition of the liquid 8, the voltage discharge may lead to the creation of hydrogen within the chamber 2*a* as molecular bonds within the liquid are broken. The created hydrogen may have beneficial effects, and in particular may increase the efficiency and/or scalability of the tool.

Figure 2B:
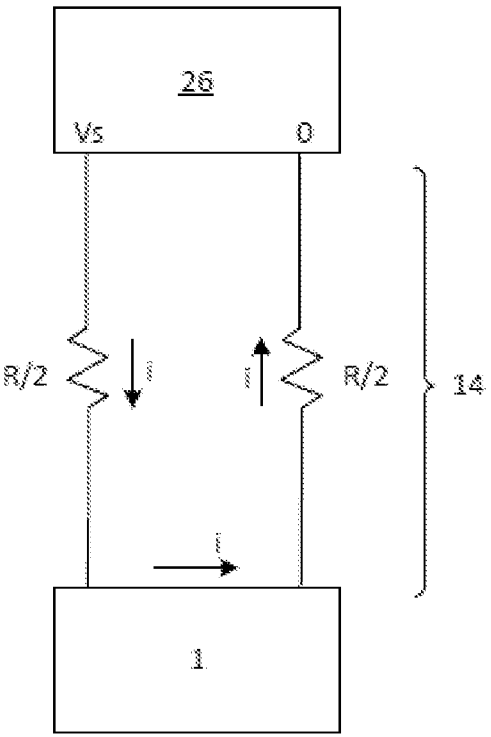
FIG. 2B is a schematic circuit diagram, showing how power is delivered to a downhole tool.
Figure 2A:
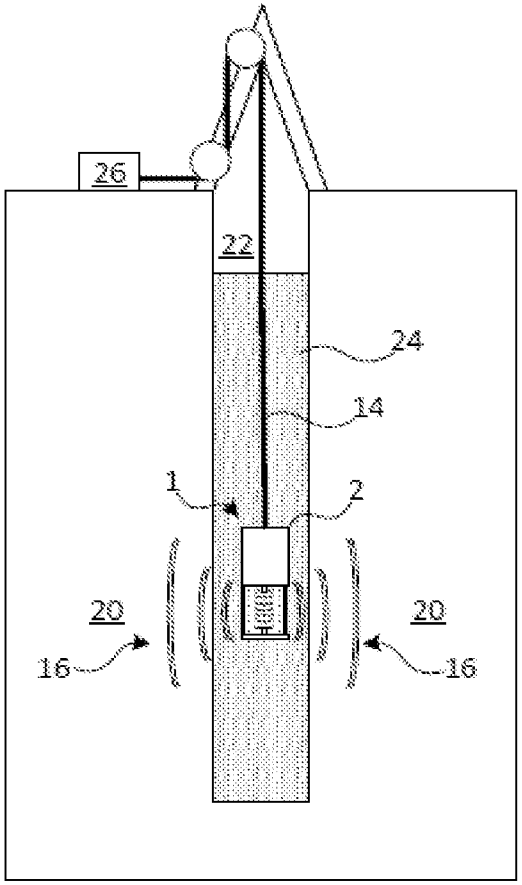
FIG. 2A illustrates a downhole tool in use in a well.

FIG. 2A shows the tool 1 in use in a vertical well 22. A series of shockwaves 16 can be seen propagating away from the body of tool 1 in a general radial direction (i.e. perpendicular to the axis of the tool 1) into the formation 20. Each of the shockwaves 16 is created by a single electrical pulse across the electrodes 5*a*, 5*b*.

The formation 20 may for example be rock, sand or a combination of oil and sand. For example, the tool 1 has applications to both wells in "traditional" assets like rock formations, but also wells in oil sands which have been recognized more recently as economically viable hydrocarbon sources.

The well 20 is at least partially filled with a well liquid 20 in which the tool 1 is submerged, so that the shockwave 16 propagates though the well liquid 24 into the formation 20. This may be a naturally occurring well fluid, or the well 22 may be deliberately flooded to optimize the propagation of the shockwave 16 (which will generally propagate more efficiently in a liquid than in a gas, and also allow the creation of a sonochemical environment within the liquid, which may not be possible in a gaseous environment).

The formation 20 is a porous medium, i.e. a matrix of solid material (such as rock or sand) supporting pockets of fluid (liquid pockets and/or gas pockets), hence the effect of the shockwave 16 on the formation 20 is described by Biot's laws.

At the surface, the other end of the cable 4 is connected to a surface power supply 26, which generates the electrical power that is supplied to the tool 1. A supply voltage Vs is supplied from the surface power supply 26 via the cable 14. The supply voltage Vs can be AC or DC, and can have a magnitude up to about 400V. For example, in some cases Vc may be a three-phase AC voltage of about 300-400, in the 10-15 Kw range.

The tool 1 will requires sufficient power for both the ultrasonic transducer, (which in turn requires an ultrasonic signal generator of sufficient power to create the sonochemical environment between the electrodes) and or the capacitor discharge system. To minimize attenuation, it is preferable to locate the electronic components inside the tool housing.

The cable 14 and tool 1 in combination have an overall electrical impedance Z, due to their electrical properties. The electrical power that can be delivered from the surface power supply 26 though the cable to the tool 1 is limited by at least the electrical resistance of the cable 14.

This is illustrated in FIG. 2B, which shows two conducting cores of the electrical cable 14 connecting the tool 1 across a supply voltage Vs generated by the surface power supply 26, each having a resistance of R/2 (i.e. more or less equal resistance). The resistance of the cables is determined by the length and thickness of the conducting cores, and the resistivity of the conducting material from which they are formed.

The total power delivered by the power source 26 is:

$$Vs*i$$

where i is the current induced by the voltage Vs and flowing though the cable 14 and tool 1. According to Ohm's law, the total power dissipated though as a result of the two R/2 resistances is:

$$2*(V_R/2)\hat{}2/(R/(2))=(V_R\hat{}2)/R$$

and the current i is $$i=(V_R/2)/(R/2)=V_R/R$$

where V_R/2 is the voltage drop across resistance R/2. Therefore, the power delivered to the tool 1 is:

$$Vs*i-(V_R\hat{}2)/R=(VsV_R)/R-(V_R\hat{}2)/R.$$

For a given value of Vs, this has a maximum value given by:

$$d/(dV_s)((VsV_R)/R-(V_R\hat{}2)/R)=0$$

which in turn yields:

$$V_R=\tfrac{1}{2}Vs$$

which in turn means the maximum (instantaneous) power that can be delivered to the tool 1 is:

$$P\ \max=\tfrac{1}{2}([\![\ Vs\ ]\!]\ \hat{}2)/R$$

i.e. the maximum power P max is half of the square of the supply voltage Vs divided by the resistance of the cable 14.

However, by storing energy in the discharge unit 4 and then releasing it across the electrodes in a very short amount of time δt (e.g. δt≈0.1 μs), it is possible to deliver a much higher transient electrical power to the electrodes for that amount of time δt. For example, a capacitor of capacitance C and charged to a voltage of Vc can deliver a transient power of order:

$$Pt=[\tfrac{1}{2}*Vc2*C]/\delta t$$

which can be much greater than P max. Note that whilst a transient power of this magnitude is possible, it may in practice be lower depending on the charging time of the capacitors.

Figure 3A:
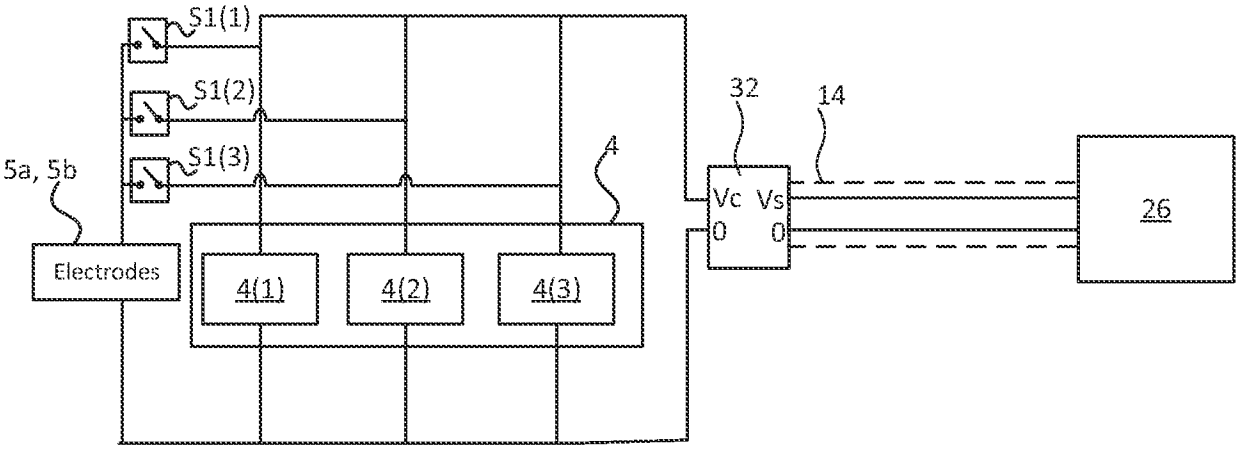
FIG. 3A shows an example of a discharge unit for a downhole tool, which comprises a plurality of capacitor units.

FIG. 3A shows a preferred configuration of the discharge unit 4. The discharge unit comprises a plurality of energy storage units 4(*n*) (where n=1, . . . N denotes the nth storage unit), each of which can store the energy needed for one electrical pulse discharge. Each energy storage unit 4(*n*) is a capacitor unit that comprises at least one capacitor (a single capacitor, or a bank of interconnected capacitors that are discharged simultaneously). The capacitor units 4(*n*) are connected in parallel to one another. Each capacitor unit 4(*n*) is periodically charged by connecting it to Vs, and then discharged across the electrodes 5*a*, 5*b*.

The voltage control unit 32 of the tool 1 generates a DC voltage Vc, for charging the capacitor units, from an AC supply voltage Vs supplied from the surface power supply 26 via the cable 14. In some cases, the voltage control unit 32 may comprise a low-to-high voltage converter, to generate the DC voltage Vc with a greater magnitude than the AC voltage Vs, e.g. Vc≈6 kV. In other cases, this may not be needed (e.g. for the capacitor unit configuration of FIG. 4, in which a voltage increase is achieved within the capacitor unit 4(*n*) itself instead—see below).

Each of the capacitor units 4(*n*) can be individually connected to across the electrodes by way of a respective switch unit S1(*n*), which may for example be a spark gap i.e. which is "closed" to discharge the capacitor unit 4(*n*) upon reaching a breakdown voltage of the spark gap. In this case, the voltage control unit 32 may discharge the capacitor unit 4(*n*) simply by charging it to the necessary voltage to achieve breakdown of the spark gap.

The voltage control unit 32 can include a controller which instigates the discharging of the capacitor units 4(*n*), 4(*n*+1) i.e. the necessary logic for the tool 1 to trigger a series of discharges discharging "autonomously" (e.g. triggering an appropriately timed series of discharges in response to one fire instruction received from the surface via the cable 14), such as a suitably programmed microcontroller, or dedicated hardware, e.g. application-specific integrated circuit or programmable hardware such as FPGA (field programmable gate array). Alternatively or in addition, such a controller may be implemented at the surface, for example as a software module of control code executed at the surface (34, FIG. 5—see below), wherein each discharge is triggered by a separate discharge instruction received via the cable 14. Either way, the voltage controller 32 comprises suitable logic (e.g. a processor executing suitable software, dedicated hardware (application specific circuitry and/or programmable hardware)) for controlling the discharging of the capacitor units 4(*n*) according to instructions received via the cable 14 from the surface.

Figure 3B:
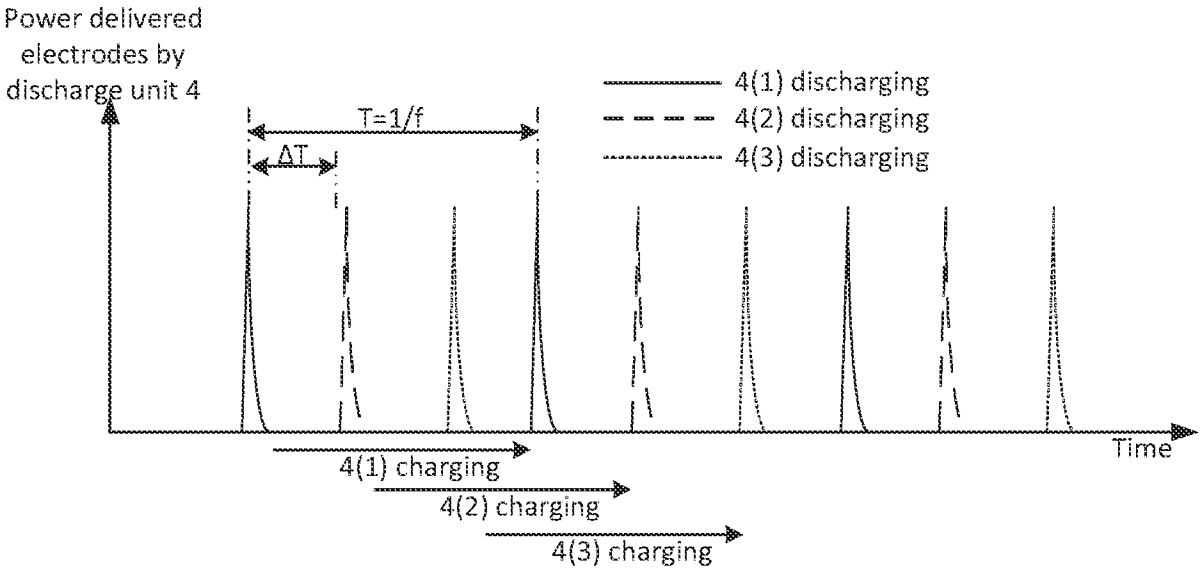
FIG. 3B shows how a plurality of capacitor units may be periodically discharged according to discharge cycles with different phases to achieve a high overall discharge frequency.

FIG. 3B shows a power graph, of electrical power delivered by the discharge unit 4 over time. The individual capacitor units 4(*n*) of the discharge unit are charged and discharged asynchronously, i.e. according to respective discharge cycles with matching periods T but that are out of phase with one another. That is, storage unit 4(*n*) is discharged at times tn, tn+T, tn+2T, . . . ; whereas storage unit 4(*n*+1) is discharged at times tn+ΔT, tn+ΔT+T, tn+ΔT+2T. Storage unit 4(*n*) can therefore be discharged before storage unit 4(*n*+1) has finished charging. This allows the frequency of discharges to be increased to:

$$Nf=1/\Delta T,$$

where f=1/T is the frequency achievable with a single storage unit. For a sufficiency high N, it is possible to achieve Nf>20 kHz, such that the discharge frequency is in the ultrasound range—corresponding to ΔT<50 ms.

In other words, the duration ΔT between successive pulses is less than a charging time of each capacitor unit 4(*n*), i.e. the time take to charge that capacitor unit sufficiently to for it to create the required voltage pulse across the electrodes 5*a*, 5*b*.

The sealed chamber 2*a* has a length along the axis of the tool 1 such that it has a resonance frequency that substantially matches Nf. Alternatively, the whole body 2 may have a length that substantially matches Nf. More generally, the tool may have a geometry such that it has a natural resonant frequency that matches Nf at least approximately. The tool may have a diameter small enough that it can fit inside oil well tubing (42 mm, typically). Or it may have a larger diameter, which requires any tubing to be removed to use the tool 1.

Each capacitor unit 4(*n*) may be a single capacitor, which allows N and hence the frequency Nf to be maximized for a given size of tool.

Figure 4:
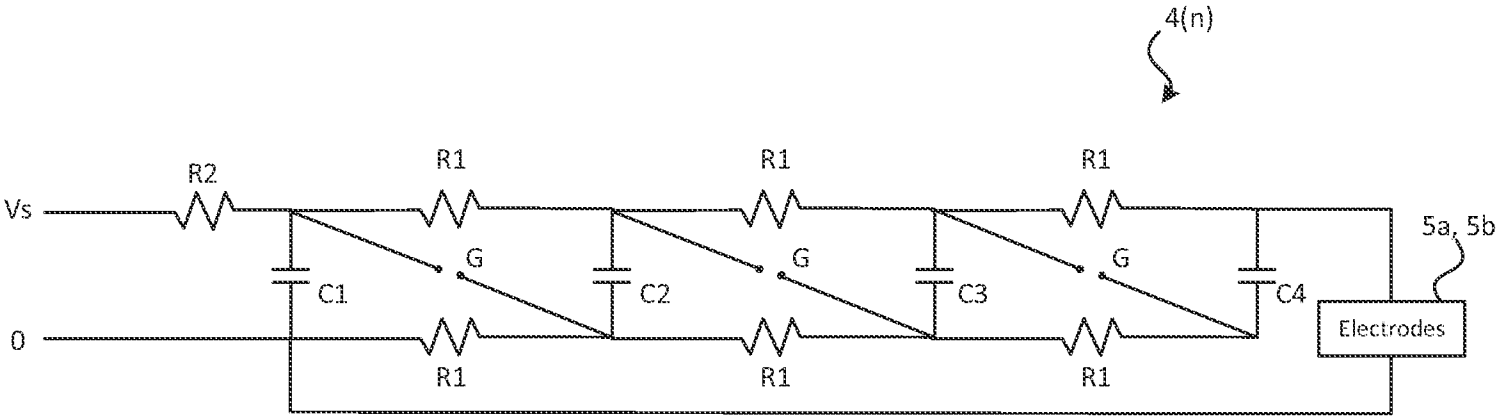
FIG. 4 shows an alternative electrical configuration for a capacitor unit.

Alternatively each capacitor unit may comprise multiple capacitors, which may for example be connected so as to form a Marx generator, as illustrated in FIG. 4.

In the Marx generator configuration of FIG. 4, a capacitor unit 4(*n*) comprises a chain of capacitors C1, . . . , CM (M=4 in FIG. 4, but this is purely exemplary) having substantially matching capacitances. When the capacitors are uncharged, they are connected in parallel to one another via resistances R1. Spark gaps G are arranged such that, upon reaching a breakdown voltage, they connect the capacitors C1, . . . , CM in series instead. The capacitors are connected across voltage Vs, connected in parallel to one another. The spark caps, capacitance and resistance R1 are chosen such that the spark gap breakdowns are achieved simultaneously when the capacitors reach approximately Vs. This causes a cascading effect, wherein a voltage of pulse having an approximate magnitude of M*Vs (i.e. M times greater than Vs, where M is the number of capacitors) is applied across the electrodes 5*a*, 5*b*, which are connected so as to form a closed circuit loop with the now series-connected chain of capacitors C1, . . . , CM (i.e. the capacitors C1, . . . , CM are discharged in series across the electrodes 5*a*, 5*b*). The capacitors may be connected to Vs via a buffering resistance R2.

A Marx generator of this kind, or a similar arrangement wherein the capacitors are charged in parallel and discharged in series, can also be incorporated in other types of electro-hydraulic tool, for example on in which the electrodes are discharged across a metallic conductor to create a metallic plasma.

Figure 3C:
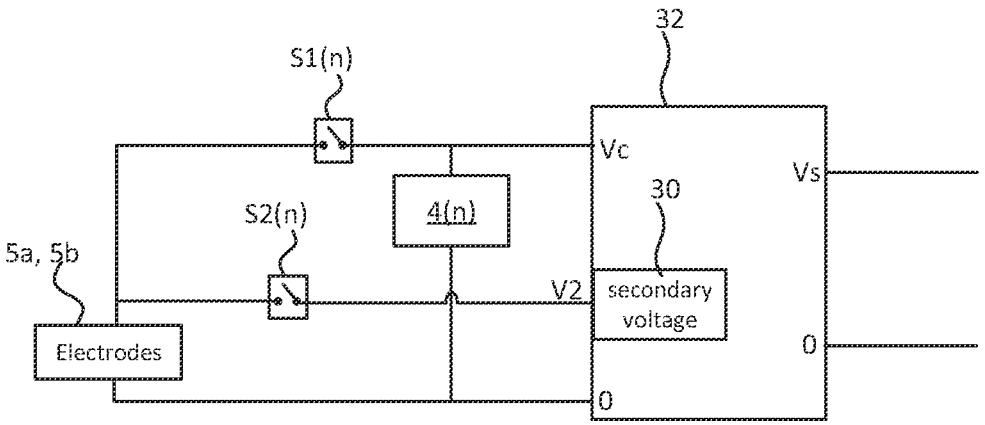
FIG. 3C shows a schematic circuit diagram of a downhole tool having a secondary voltage supply circuit.

FIG. 3C shows a highly schematic circuit diagram, illustrating certain electrical components of an embodiment of the tool 1. One of the capacitor unis 4(*n*) is shown, which operates as described above to charge when its respective switch S1(*n*) is and to discharge across the electrodes 5*a*, 5*b* when S1(*n*) is closed. A secondary voltage supply circuity 30 of the voltage controller 32 is controllable via a second switch unit S2 to selectively provide a secondary voltage V2 across the electrodes 5*a*, 5*b* directly from the cable 14 for a duration Δt.

Figure 3D:
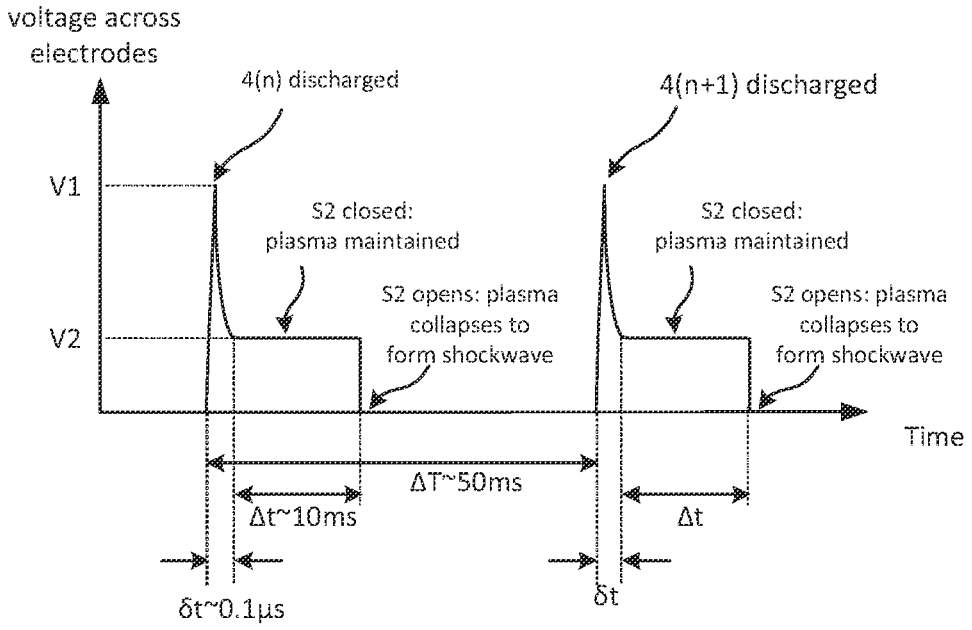
FIG. 3D shows how a secondary voltage supply circuit may be used to briefly maintain a plasma formed by a pulse voltage, to increase its energy before allowing it to collapse.

FIG. 3D is a graph showing exemplary changes in the voltage across energy storage unit 4(*n*) and the electrodes 5*a*, 5*b*. The secondary voltage V2 is applied across the electrodes by the secondary voltage supply circuity 30 for at least for a short duration Δt after the pulse voltage is applied by storage unit 4(N), as illustrated in the graph of FIG. 4C. The secondary voltage V2 is shown as DC, but it may be AC.

The pulse voltage (labelled V1) creates the plasma, and the secondary voltage V2 maintains it i.e. prevents it from collapsing as soon as the pulse voltage V1 has decayed (which it would otherwise do). At the end of this duration Δt, the secondary voltage V2 is removed by opening S2 causing the plasma to collapse and the shock wave 16 to form. For the short duration Δt that the secondary voltage V2 is applied, energy is supplied to the plasma directly from the electrical cable 14 via the secondary voltage supply circuit 30, thereby increasing the energy of the plasma and hence the shockwave 16 above the energy provided by storage unit 4(*n*). This is made possible by the cavitation induced by the acoustic field 10.

For the avoidance of doubt it is noted that the secondary voltage V2 is not essential. Particularly where the objective is to repeat the pulses as frequently as possible to create a sufficiently powerful external ultrasonic field, there may not be a need for the secondary voltage V2.

The secondary voltage V2 is direct in the sense that electrical power is delivered directly from the surface power supply 26 via the cable 14 to the electrodes 5*a*, 5*b* for the duration Δt (not from the discharge unit 4). The amount of power that can be delivered during this interval Δt is limited to:

$$P\text{direct}=P\max-Pc$$

where Pc is the electrical power that is being simultaneously delivered to the discharge unit 4 to charge one or more of the capacitor units 4(*n*).

The energy of the plasma, and therefore the energy of each shockwave 16, can be increased by up to:

$$\int_{\Delta t} [P\text{direct}\, dt] \approx P\text{direct}*\Delta t$$

though some energy loss may occur in practice.

Note that:

$$\delta t<\Delta t<\Delta T$$

where:

Δt is the duration of the transient pulse voltage V1—around 0.1 microseconds;

Δt is the duration for which the plasma formed by the pulse voltage V1 is maintained by the secondary voltage V2—about 10 microseconds (order of magnitude);

ΔT is time between capacitor unit 4(*n*) discharging and capacitor unit 4(*n*+1) discharging—which can vary depending on the circumstances, but may be e.g. about 50 milliseconds The transient pulse duration Δt is therefore several orders of magnitude smaller than Δt and ΔT.

The liquid 8 may for example be an alkaline solution, for example saltwater. However that is just one example, and the liquid 8 can have any physical and chemical properties that is susceptible to the creation of a plasma event.

Advantages of sealing the electrodes 5*a*, 5*b* and liquid 8 within the chamber 2*b* are that improved reliability of the tool, as there are no or minimal variations in conductivity of the working fluid. The conductivity and volatility of the fluid 8 can be kept within precise limits for optimal reliability.

Nevertheless, although less preferred in some contexts, in alternative embodiments, the tool 1 may instead have electrodes located such that when the tool 1 is in the well liquid 24, the electrodes are submerged in and thus discharged across the well fluid itself 24, i.e. external electrodes. In this case, acoustic field is applied to induce cavitation in a volume of the well fluid 24 itself, so as to cause it to form a plasma and resulting shockwave upon its collapse.

The well liquid 24 may be an alkaline solution, such as saltwater.

One advantage of this arrangement is that the process by which the plasma is created (by the externals electrodes and acoustic field) may also create hydrogen, e.g. as molecular bonds in the liquid 24 in the well and/or molecular bonds within the surrounding formation 20 are broken down. This may cause a release of hydrocarbons or other target natural resource form the formation 20 and/or assist in the transport of the target natural resource to the surface. Hydrogen is known to have applications in the field of enhanced oil recovery, however the creation of hydrogen downhole using an acoustic (e.g. ultrasound) field is new.

Another advantage is that the process by which the plasma is created (by the externals electrodes and acoustic field) may also create nanoparticles, which are a by-product of certain plasmas. This may also cause a release of hydrocarbons or other target resource form the formation 20 and/or assist in the transport of the target natural resource to the surface. Nanoparticles are known to have applications in the field of enhanced oil and gas recovery, however their creation downhole using an acoustic (e.g. ultrasound) field is new. For example, when applied to oil sands, the nanoparticles may beneficially coat sand particles, which assists in the recovery of oil from the oil sands and/or the separation of the oil form the sand. It is also possible that the nanoparticles may coat the external electrodes which may improve their performance and/or extend their working life. The ultrasound may also cause a removal of bubbles from the electrode surfaces. The electrodes may be coated with a nanopaint to protect them prior to use downhole.

The nanoparticles may be magnetite (Fe3O4), which is ferromagnetic. Small grains of magnetite already occur naturally in all igneous and metamorphic rocks. Thus the addition of magnetite nanoparticles to a downhole environment is endemic, and beneficial from an environmental perspective. In particular, magnetite nanoparticles are more environmentally friendly than polymer ones, for example.

Another advantage of generating magnetite nanoparticles from the sonoplasma is that they can be used to heat the well by applying an oscillating magnetic field across the well containing the nanoparticles. Because of their magnetic properties, the nanoparticles interact with the magnetic field to release energy in the form of heat.

The magnetite nanoparticles may also facilitate cleaning of wastewater extracted from the well, due to their magnetic properties.

The ultrasonic field may result in in more hydrogen production, and may also improve mass transfer and lead to a 10-15% energy saving as compared to use of a pulse voltage alone.

Figure 5:
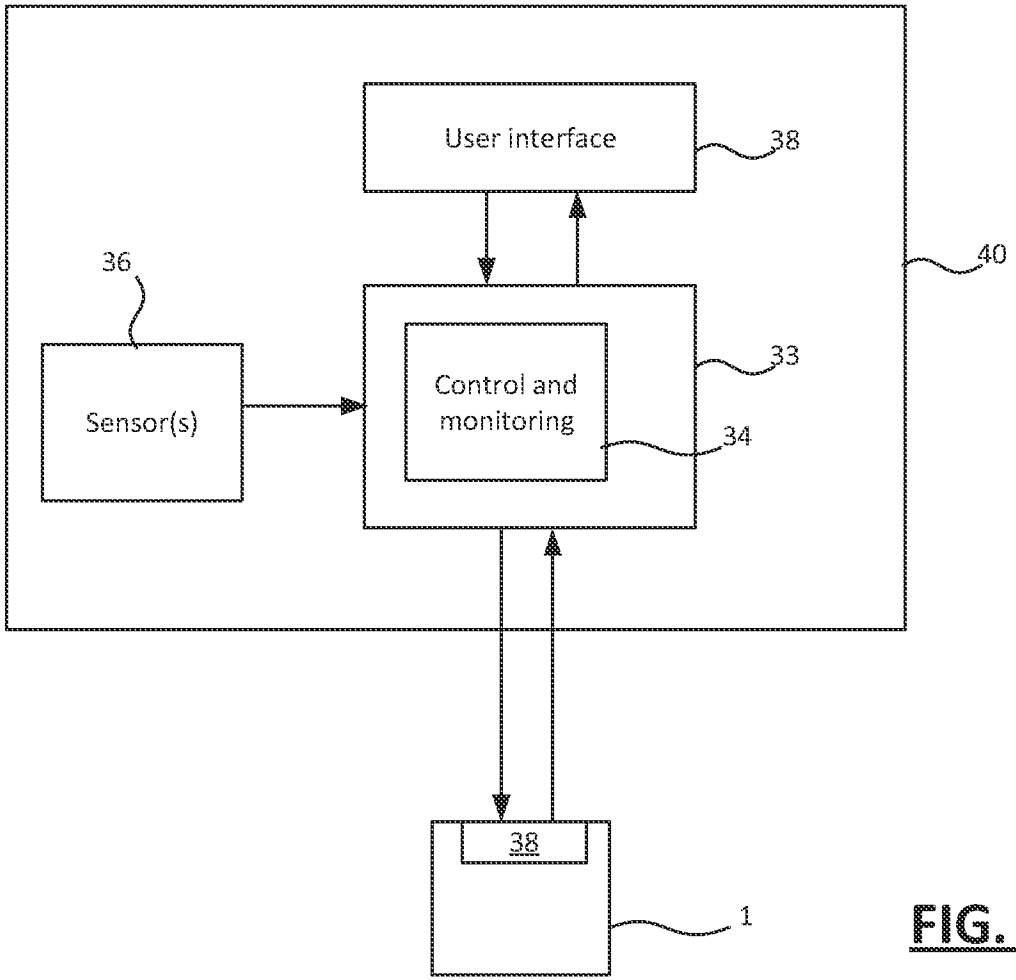
FIG. 5 shows a control system for a downhole tool.

FIG. 5 shows a control system 40 for controlling and monitoring the operation of the tool 1 in use. The system 40 comprises a controller in the form of at least one processor 33, on which control code 34 is executed. The system also comprises a user interface 38 connected to the processor 33 for use by a tool operator. The user interface comprises at least one output device, such as a display, and at least one input device, such as a mouse, trackpad, touchscreen etc. (not shown).

The processor 33 is connected to a control interface 38 of the downhole tool, so as to provide two-way communication between the tool 1 and the processor via the cable 40 when the tool 1 is deployed.

The tool operator can instigate instructions to the tool 1, which are generated by the control code 34 in response to control input received via the user interface 38. For example, the operator may be able to "fire" (i.e. discharge) the tool 1 manually, or set an operating frequency of the tool (Nf in the above examples), i.e. a frequency for a series of automatic discharges.

The tool 1 transmits monitoring data back up to the surface via the cable 14, which is outputted to the operator by the control code 34 via the user interface 38, allowing the operator to monitor the performance of the tool 1 in use, for example confirmation signals (confirming when the tool has fired), and/or sensor data from any on-board sensor(s) of the tool, e.g. one or more temperature sensors, pressure sensors, and/or motion sensors etc.

The processor can also be connected to one or more external sensors 36, e.g. sensors locate in neighbouring wells, at the surface of the formation being treated, or in the well 22 itself, and information collected from these can be outputted to the operator via the user interface 38 so that he can monitor any externally-observed effects of the tool 1, and control the operation of the tool 1 accordingly.

Note that, although software is the preferred implantation of the surface controller, at least part of its functionality may nonetheless be implemented using dedicated hardware.

Tool Power:

The shockwave 16 has a broadband power spectrum Φ(f,r) within the formation 20, i.e. its energy is distributed over a wide range of acoustic vibration frequencies [f_lo, f_hi]. That is, the shockwave 16 induced vibrations in the formation 20 having a wide range of frequencies. The power spectrum Φ(f,r) means the spectral power distribution of the shockwave 16 i (i.e. power per unit area per unit frequency) as measured at point r in the formation 20.

With the above-describe configuration of the downhole tool 1, it is expected to be possible to induce a broadband acoustic spectrum that includes high power ultrasound. That is, a vibrations over a continuous range frequencies, wherein the total cumulative power flux density per unit area of all frequencies ≤f_u is at least as great as a threshold Φ_u (referred to as the power threshold for conciseness, noting that it is in fact a power flux density) enough to induce physical effects in the formation 20 that are characteristic of ultrasound. This can be expressed mathematically as:

$$\Phi(f,r)>0\forall f\in[f_lo,f_hi] \quad (1)$$

$$\int_(f_u)^{\infty} [\![ \Phi(f,r)df ]\!] \geq \Phi_u \quad (2)$$

for at least one point r in the formation 2 receiving the shockwave 20.

The ultrasound frequency f_u≈20 kHz. For a typical formation 20, the power threshold ⟦Φ⟧_u may be about 0.8-1 W/cm2. The lower-limit f_lo of the broadband spectrum may for example be 500 Hz or less, e.g. 50 Hz or less, e.g. 5 Hz or less, e.g. 0.5 Hz or less. The upper-limit f_hi>f_u.

Tuning the Downhole Tool:

It can be beneficial to adapt the discharge frequency Nf of the tool 1, so as to optimize it to the particular formation 20 to be treated, for example based on a geophysical analysis of the formation 20. For example, a relatively basic analysis may involve estimating four characteristics of the formation 20 and the fluid it contains, namely:

- the porosity φ of the formation 20,
- permeability κ of the formation 20,
- the density δ of the fluid it contains, which may be oil (light-to-medium oil, or heavy oil) or water, and
- the dynamic viscosity η of the fluid.

For example, the discharge frequency Nf may set so that it is at least as great as a characteristic frequency f_c:

$$Nf \geq f_c := F_A\ \eta\phi/\kappa\delta$$

where F_A is an amplitude factor for displacement of the fluid in the porous formation 20 relative to the formation 20 itself i.e. the solid matrix. For example, F_A≈0.1.

However, preferably, at least one of the following characteristics of the formation 20 and/or the well 22 is estimated and used to tune the discharge frequency Nf (and/or another operating parameter of the tool 1):

- speed of sound in the formation 20,
- oil-to-water ratio,
- oil-to-gas ratio,
- neutron density of the formation 20
- interfacial boundary estimate, or
- a consolidation measure for the formation 20 (which, broadly speaking, denotes where the formation lies between pure sand and pure rock),
- An API gravity of a fluid (e.g. hydrocarbon or other resource) in the well or formation.

That is one of these characteristics, or any combination of two or more of these characteristics.

Regarding 9, within the microscopic capillary and pore structure of the reservoir the interfaces between the solids, liquids of different densities, and gasses can become barriers to the mobility of the fluids. An effective sonochemical environment will disrupt these boundaries making the fluid more mobile. The interfacial boundary estimate may for example comprise an estimate of an energy, force or pressure differential needed to overcome one or more of these types of boundary.

Any one (or more) of characteristics 1-11 may also be used to determine a treatment duration, over which the downhole tool 1 is used in the well 22 to treat the formation 20.

Note that this also applies to other types of tool, e.g. other types of electrohydraulic tool or transducer-based tools. That is, an operating frequency of and/or a treatment duration for other type of downhole can be set based on estimates of the above-mentioned formation/well characteristics.

Use Cases:

The downhole tool 1 can be used on a variety of formation types, in order to increase production: both to increase the recovery of a well (i.e. to increase the total amount of hydrocarbon that is recoverable from that well), and to increase the flow rate (i.e. the rate at which hydrocarbon is recovered from the well).

It can be used on both "conventional" oil-assets, i.e. formations bearing light-to-medium oil; "non-conventional" oil assets, i.e. formations bearing heavy oil; and gas-bearing formation, including tight-gas formations.

Although the tool 1 can achieve these beneficial effects without the need for other treatment, in some cases it may be beneficial to combine treatment performed with the tool 1 with another type(s) of treatment, such as:

- heat treatment
- fracking
- chemical treatment,
- all types of artificial lift mechanisms, e.g. using a jet pump(s) or an advanced artificial lift system such as an electric-submersible pump(s),
- well-flooding, e.g. of a gas well to assist the propagation of the shockwave(s) 16, which may be necessary for a gas well,
- water-injection, (for voidage replacement & pressure maintenance)
- EOR, (enhanced oil recovery) & IOR (improved oil recovery) methodologies.

Diluent Injection

That is, one of these additional treatments, or any combination of two or more thereof.

Moreover, the application of the tool 1 is not limited to vertical wells. By using a suitable drive mechanism, such as a coiled tubing coupled to the tube 1, it can also be deployed in horizontal wells.

Asset Evaluation:

In deciding whether or not to deploy the tool 1 on a given well or formation, a well operator (typically a team of people) may utilize asset evaluation software. The asset valuation software is executed on a computer, and receives as inputs parameters and data relating to the well, such as its geophysical properties (e.g. those mentioned above), performance metric(s), e.g. denoting, say, its current and/or historic hydrocarbon or other natural resource output (e.g. barrels per day), sensor data e.g. from sensors 36, and economic data pertaining to the hydrocarbon(s) and/or other natural resource(s) in question. The asset valuation processes these inputs in order to generate a technical evaluation, indicating an estimated time at which the well 16 will become uncommercial. An expert can assess the valuation report, to make an informed decision as to whether use of the tool 1 can extend the commercial life of the well, by estimating a likelihood of treatment being successful and cost-efficient. A factor in this is whether the well needs to be taken out of operation whilst the tool 1 is used, though this may not always be necessary i.e. in some cases it may be viable to use the tool 1 on a well that remains operational during the treatment.

Variations

The examples above use acoustic energy (i.e. of the acoustic field 10) in combination with a second type of energy to create a plasma and cavity that collapse to form a shockwave. The acoustic energy is provided by a first energy source, which is a transducer in the above examples. In the examples above, this second type of energy is electrical energy from a discharging capacitor bank (second energy source).

However, variations of this are within the scope of some aspects of the present invention. In particular, alternative forms of both the first energy source and the second energy source.

An aspect of the present invention is directed to method of applying acoustic stimulation to a resource-bearing formation, in which a first energy source is used to generate an acoustic field at a location in the and/or to induce cavitation in a volume of liquid within the formation (which location/cavitating volume may or may not be in a well in the formation and may or may not be within a downhole tool in the formation); and a second energy source is used to direct energy into the acoustic field and/or the cavitating volume of liquid, to assist in the recovery of a resource from the formation. For example to cause a release of the resource from the formation or to otherwise assist in the recovery of the resource. For example, energies from the first and second energy sources may interact to form a sonoplasma.

The first energy source can take any form, and generate any form of energy that causes the effect in question within the formation. The second energy source can take any form that is susceptible to direction into the acoustic field/cavitating volume.

For example, in certain circumstances, it may be possible to introduce the electrical energy without a capacitor bank and possibly even without a cable, e.g. by applying a voltage across the well 24 and/or formation 20 directly, and generating the acoustic field within the well, using a transducer or some other mechanisms, e.g. to induce cavitation whilst applying this voltage across the well. For example, using one electrode located at the surface and another within the formation 20. Applying a large voltage across all or part of a well and/or formation is known from so-called electro fracking. However, the application of an acoustic field to induce cavitation and/or other characteristic ultrasound effects within the well and/or formation at the same time is novel.

As another example, this second energy need not be electrical energy as such. For example, it could be electromagnetic energy e.g. microwaves, or even visible light, infrared or ultraviolet electromagnetic radiation, for example generated by a laser, gamma rays or radio waves. An electromagnetic source, such as a microphone source or laser, can be incorporate in the tool 1, or alternatively it can be located at the surface, i.e. a surface electromagnetic generator can project electromagnetic radiation (e.g. microwaves, laser or any of the above-mentioned types of electromagnetic radiation etc.) downhole into an ultrasound field generated downhole, e.g. using a transducer or by some other mechanism, for example to induce cavitation downhole. For example, a higher power microwave or laser source at the surface can be used to project focused microwaves downhole, such devices being known for example in the field of military technology. For example, the electromagnetic waves may create electric waves in a working fluid (liquid 8, or well liquid 24 for example).

Whatever form of energies are used, this cause sonoluminescence, i.e. a visibly glowing plasma, cause by the release of radiation in a visible spectrum from the plasma. The visible light of the sono-luminescence downhole may not be visible at the surface, but is nevertheless still present.

Alternatively the second energy source may be configured so to as to manipulate a flow of the liquid to induce hydrocavitation, as noted above. That is to say, the cavitation that drives a sonochemical reaction can be created through other methods, for example hydrodynamic rather than acoustic. Hydrodynamic cavitation is process of vaporization, bubble generation and bubble implosion, similar to cavitation induced by an acoustic field. For example, cavitation can be created hydrodynamically by pushing a liquid through a constricted channel, using the energy of the second energy source. For example, the second energy source may comprise an electrical pump, electrically control valve (e.g. electric valve), heating element, and/or a suction element or other pressure-gradient inducing mechanism, and may also comprise (say) one or more valves, nozzles, tubes etc. arranged to effect a desired fluid flow to induce the cavitation.

For example, the first energy source may comprise a hydrodynamic transducer. For example, the first energy source may comprise a jet pump.

Note even though the cavitation may not be generated acoustically be means of an acoustic field, the effect can still be acoustic, namely the formation of the shockwave(s) that propagate into the formation to induce an acoustic stimulation effect, for example a rapid series of shockwaves that induces a sonochemical reaction within the formation. This constitutes a sonochemical stimulation of a resource resulting in acoustic frequencies penetrating the resource, by whatever means the cavitation is induced.

Hydrodynamic cavitation may cause a linear sonochemical reaction, and acoustic cavitation may be sinusoidal. Hydrodynamic cavitation may be easier and less expensive in some contexts.

When cavitation is uncontrolled it is damaging but if its controlled it results in high energy temperatures and pressures on the surface of the bubbles for a short time, which can be beneficial in creating the sonoplasma.

An alternative or additional function of the software 34 of FIG. 5 is to detect a hydrogen spike (e.g. using molecular spectroscopy) as a result of the sonoplasma, control the second energy source (e.g. laser or microwave generator) and perfectly time the injection of electromagnetic or microwave stimulation into the acoustic bubble at that point creating an intense heating effect, by which means latent heat may be generated downhole so as to produce a self-generating thermoelectric electrical current. Using this technique, it may be possible to generate a shockwave with a lower voltage, and thus without (say) a Marx generator or low-to-high voltage converter. Alternatively the Marx may be used to kick start the reaction, i.e. to provide an initial injection of energy note. For example, the sonoplasma may have a rising volt-ampere characteristic that is harnessed at an exact moment in the process.

A signal from the software 34 may trigger a switch at the time the hydrogen production from the ultrasonically exposed sonoplasma spikes and that energy may be harnessed through the simultaneous addition of e.g. microwave heating into the acoustic gas bubble (or other energy from a second energy source). This is then harnessed in a controlled way during the spike by software 34 monitoring. An override emergency shut off mechanism may be provided, which may be implemented automatically by the software 34 or manually using a safety switch.

The above-described embodiments of the present invention are exemplary, and other variations and uses fall within the spirit and scope of the present invention. The scope is not limited by the described examples, but only by the following claims.

The invention claimed is:

1. A system for applying acoustic stimulation to a resource-bearing formation, the system comprising:

a first energy source configured to generate an acoustic field and thereby induce cavitation in a volume of liquid at a location in the formation or resource;

a second energy source configured to direct energy into the acoustic field, such that a combination of acoustic energy of the acoustic field and the directed energy interact to create hydrogen and cause a release of a resource from the formation;

one or more sensors configured to monitor the location of the acoustic field or the cavitating volume of liquid, wherein the one or more sensors are configured to monitor a hydrogen spike; and a control system configured to direct energy into the acoustic field or cavitating volume of liquid.

2. The system of claim 1 wherein the first energy source comprises a hydrodynamic cavitation induction mechanism.

3. The system of claim 2, wherein the hydrodynamic cavitation induction mechanism comprises a pump, a control valve, a heating element, a suction element, a jet pump, and/or a hydrodynamic transducer.

4. The system of claim 1, wherein the second energy source comprises an electromagnetic energy source.

5. The system of claim 1, wherein the directed energy and the acoustic field or the cavitating liquid interact to form a plasma, which collapses to form a shockwave.

* * * * *